US009412301B2

(12) United States Patent
In et al.

(10) Patent No.: US 9,412,301 B2
(45) Date of Patent: Aug. 9, 2016

(54) ORGANIC LIGHT-EMITTING DISPLAY APPARATUS AND PIXEL

(71) Applicant: SAMSUNG DISPLAY CO., LTD., Yongin, Gyeonggi-Do (KR)

(72) Inventors: Hai-Jung In, Yongin (KR); Il-Hoon Jeong, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 266 days.

(21) Appl. No.: 14/279,267

(22) Filed: May 15, 2014

(65) Prior Publication Data

US 2015/0170562 A1 Jun. 18, 2015

(30) Foreign Application Priority Data

Dec. 16, 2013 (KR) ..... 10-2013-0156645

(51) Int. Cl.
*G09G 3/32* (2016.01)
*G09G 3/20* (2006.01)

(52) U.S. Cl.
CPC ..... *G09G 3/3258* (2013.01); *G09G 3/2029* (2013.01); *G09G 2300/0413* (2013.01); *G09G 2300/0819* (2013.01); *G09G 2330/10* (2013.01); *G09G 2330/12* (2013.01)

(58) Field of Classification Search
CPC ..... G09G 3/3258; G09G 3/2029; G09G 2300/0413; G09G 2330/10; G09G 2300/0819; G09G 2330/12
See application file for complete search history.

(56) References Cited

U.S. PATENT DOCUMENTS

| | | | | |
|---|---|---|---|---|
| 2005/0180083 | A1* | 8/2005 | Takahara | G09G 3/006 361/152 |
| 2010/0044691 | A1 | 2/2010 | Hong et al. | |
| 2010/0207106 | A1 | 8/2010 | Lhee et al. | |
| 2012/0146034 | A1 | 6/2012 | Hong et al. | |
| 2013/0293526 | A1* | 11/2013 | Igawa | G09G 3/3696 345/212 |
| 2016/0035283 | A1* | 2/2016 | Park | G09G 3/3258 345/214 |

FOREIGN PATENT DOCUMENTS

| | | | |
|---|---|---|---|
| JP | 2007-316511 | A | 12/2007 |
| KR | 10-0666639 | B1 | 1/2007 |
| KR | 10-0932989 | B1 | 12/2009 |
| KR | 10-1022156 | B1 | 3/2011 |
| KR | 10-2011-0057552 | A | 6/2011 |
| KR | 10-1156447 | B1 | 6/2012 |

* cited by examiner

*Primary Examiner* — Andrew Sasinowski
(74) *Attorney, Agent, or Firm* — Lewis Roca Rothgerber Christie LLP

(57) ABSTRACT

An organic light-emitting display apparatus including emitting pixels including drivers for displaying gradation by making a light-emitting device selectively emit light according to a logic level of a data signal transmitted to each of the subfields forming a frame, and dummy pixels coupled to a repair line that is coupled to a light-emitting device of a first emitting pixel from among the plurality of the emitting pixels, wherein the dummy pixels include a first dummy driver for making the light-emitting device of the first emitting pixel emit light by charging the repair line when a data signal having a first logic level is transmitted, a second dummy driver for discharging the repair line when a data signal having a second logic level opposite to the first logic level is transmitted, and a boost capacitor coupled to the repair line and for controlling a charging/discharging speed of the repair line.

20 Claims, 9 Drawing Sheets

ORGANIC LIGHT-EMITTING DISPLAY APPARATUS AND PIXEL

CROSS-REFERENCE TO RELATED APPLICATION

This application claims priority to and the benefit of Korean Patent Application No. 10-2013-0156645, filed on Dec. 16, 2013 in the Korean Intellectual Property Office, the disclosure of which is incorporated herein in its entirety by reference.

BACKGROUND

1. Field

One or more embodiments of the present invention relate to an organic light-emitting display apparatus, pixels thereof, and a method of driving the organic light-emitting display apparatus.

2. Description of the Related Art

When there are defects in certain pixels, the defective pixels may always generate light regardless of scanning signals and data signals. Pixels that always generate light are recognized as bright spots that are highly visible and thus easily observed by observers.

Because an organic light-emitting display apparatus has a complex pixel circuit and a process of manufacturing the organic light-emitting display apparatus is complicated, a yield may be decreased due to defective pixels as the organic light-emitting display apparatus is made large and has high resolution.

SUMMARY

Aspects of embodiments of the present invention are directed toward an organic light-emitting display apparatus that increases a production yield and reduces quality degradation by identifying and repairing defective pixels, thus allowing them to be normally driven.

Additional aspects will be set forth in part in the description which follows and, in part, will be apparent from the description, or may be learned by practice of the presented embodiments.

According to an embodiments of the present invention, there is provided an organic light-emitting display apparatus including: a plurality of emitting pixels each including a light-emitting device and a driver configured to display a gradation by enabling the light-emitting device to selectively emit light according to a logic level of a data signal transmitted corresponding to each of a plurality of sub-fields forming a frame; and dummy pixels coupled to a repair line, the repair line being coupled to a light-emitting device of a first emitting pixel from among the plurality of emitting pixels, wherein each of the dummy pixels includes: a first dummy driver configured to make the light-emitting device of the first emitting pixel emit light by charging the repair line when a data signal having a first logic level is transmitted; a second dummy driver configured to discharge the repair line when a data signal having a second logic level opposite to the first logic level is transmitted; and a boost capacitor configured to control a charging and/or discharging speed of the repair line, the boost capacitor being coupled to the repair line.

In an embodiment, the first dummy driver includes: a first transistor configured to be turned on by a scanning signal and to receive the data signal; a second transistor configured to be turned on by the data signal having the first logic level and to transmit a first source voltage to the light-emitting device of the first emitting pixel; and a dummy capacitor configured to store a voltage that corresponds to the data signal.

In an embodiment, the second dummy driver includes a third transistor configured to block a connection of the second dummy driver to the repair line by being off when the data signal having the first logic level is transmitted to the first dummy driver, and to discharge the repair line after coupling the second dummy driver to the repair line by being on when the data signal having the second logic level is transmitted to the first dummy driver, wherein the boost capacitor is coupled between the third transistor and the repair line.

In an embodiment, the organic light-emitting display apparatus further includes: a fourth transistor configured to transmit a first source voltage to a first node by being on when the data signal having the first logic level is transmitted to the first dummy driver; a fifth transistor configured to transmit a second source voltage to the first node when the data signal having the second logic level is transmitted to the first dummy driver, the second source voltage being lower than the first source voltage; and a sixth transistor configured to turn on by a scanning signal, to turn off the third transistor when a voltage of the first node is at the first source voltage, and to turn on the third transistor when the voltage of the first node is at the second source voltage.

In an embodiment, the second dummy driver further includes a fourth transistor configured to turn on by a scanning signal, to turn on the third transistor by receiving a reverse data signal having the first logic level when the data signal having the second logic level is transmitted to the first dummy driver, and to turn off the third transistor by receiving a reverse data signal having the second logic level when the data signal of the first logic level is transmitted to the first dummy driver.

In an embodiment, the repair line is charged or discharged, a voltage of the boost capacitor respectively increases or decreases as a voltage of the repair line increases or decreases, and the boost capacitor maintains a voltage level of a gate electrode of the third transistor to turn on or off the third transistor.

In an embodiment, the drivers of the emitting pixels include: a switching transistor configured to turn on by a scanning signal and to receive the data signal; a driving transistor configured to turn on or off according to the logic level of the data signal; and a capacitor configured to store a voltage corresponding to the data signal.

In an embodiment, the light-emitting device of the first emitting pixel is separated from the drivers and coupled to the repair line.

In an embodiment, the emitting pixels are in a display area, and the dummy pixels are in a dummy area adjacent to the display area.

In an embodiment, the dummy pixels are coupled to a dummy scanning line before a first scanning line of a plurality of scanning lines of a display area or a dummy scanning line after a last scanning line of the plurality of scanning lines of the display area.

According to an embodiments of the present invention, there is provided a pixel configured to adjust a light-emitting time of an external pixel to display gradation, by the external pixel, based on a logic level of a data signal transmitted to each of a plurality of sub-fields forming a frame, the pixel including: a first transistor including a gate electrode configured to receive a scanning signal, a first electrode configured to receive the data signal having a first logic level or a second logic level opposite to the first logic level, and a second electrode coupled to a first node; a second transistor including a gate electrode coupled to the first node, a first electrode configured to receive a first source voltage, and a second electrode coupled to a fourth node; a third transistor including a gate electrode coupled to a second node, a first electrode coupled to the fourth node, and a second electrode configured to receive a second source voltage, the second source voltage being lower than the first source voltage; a fourth transistor including a gate electrode coupled to the first node, a first electrode configured to receive the first source voltage, and a second electrode coupled to a third node; a fifth transistor including a first electrode coupled to the third node, a gate electrode and a second electrode diode-coupled and receiving the second source voltage; a sixth transistor including a gate electrode configured to receive the scanning signal, a first electrode coupled to the third node, and a second electrode coupled to the second node; a first capacitor including a first electrode coupled to the first node, and a second electrode configured to receive the first source voltage; and a second capacitor including a first electrode coupled to the second node, and a second electrode coupled to the fourth node, wherein the fourth node is insulated from a repair line by interposing an insulation layer.

In an embodiment, the fourth node is electrically coupled to the repair line, the repair line being coupled to a light-emitting device of the external pixel, the first transistor is configured to transmit the data signal having the first logic level to the first node to turn on the second transistor; and the sixth transistor is configured to transmit the first source voltage, to the second node to turn off the third transistor, the first source voltage being transmitted to the third node by the fourth transistor turned on by the data signal having the first logic level, In an embodiment, when the first transistor and the sixth transistor are turned off as the scanning signal is reversed in the sub-field, the second capacitor is coupled to the repair line to keep the third transistor off.

In an embodiment, the fourth node is electrically coupled to the repair line, the repair line being coupled to a light-emitting device of the external pixel, the first transistor is configured to transmit the data signal of the second logic level to the first node and turns off the second transistor, and the sixth transistor is configured to transmit the second source voltage to the second node to turn on the third transistor, the second source voltage being transmitted to the third node by the fifth transistor when the fourth transistor is turned off by the data signal having the second logic level.

In an embodiment, when the first transistor and the sixth transistor are turned off as the scanning signal is reversed in the sub-field, the second capacitor is coupled to the repair line to keep the third transistor on.

According to an embodiments of the present invention, there is provided a pixel configured to adjust a light-emitting time of an external pixel to display gradation, by the external pixel, based on a logic level of a data signal transmitted to a plurality of sub-fields forming a frame, the pixel including: a first transistor including a gate electrode configured to receive a scanning signal, a first electrode configured to receive the data signal having a first logic level or a second logic level opposite to the first logic level, and a second electrode coupled to a first node; a second transistor including a gate electrode coupled to the first node, a first electrode configured to receive a first source voltage, and a second electrode coupled to a third node; a third transistor including a gate electrode coupled to a second node, a first electrode coupled to the third node, and a second electrode configured to receive a second source voltage, the second source voltage being lower than the first source voltage; a fourth transistor including a gate electrode configured to receive the scanning signal, a first electrode configured to receive a reverse data signal opposite to the data signal, and a second electrode coupled to the second node; a first capacitor including a first electrode coupled to the first node, and a second electrode configured to receive the first source voltage; and a second capacitor including a first electrode coupled to the second node, and a second electrode coupled to the third node, wherein the third node is insulated from a repair line by interposing an insulation layer.

In an embodiment, the third node is electrically coupled to the repair line, the repair line being coupled to a light-emitting device of the external pixel, the first transistor is configured to transmit the data signal having the first logic level to the first node to turn on the second transistor, and the fourth transistor is configured to transmit the reverse data signal to the second node to turn off the third transistor.

In an embodiment, when the first and fourth transistors are turned off as the scanning signal is reversed in the sub-field, the second capacitor is coupled to the repair line to keep the third transistor off.

In an embodiment, the third node is electrically connected to the repair line, the repair line being coupled to a light-emitting device of the external pixel, the first transistor is configured to transmit the data signal having the second logic level to the first node to turn off the second transistor, and the fourth transistor is configured to transmit the reverse data signal to the second node to turn on the third transistor.

In an embodiment, when the scanning signal is reversed in the sub-field, and the first and fourth transistors are turned off, the second capacitor is coupled to the repair line to keep the third transistor on.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
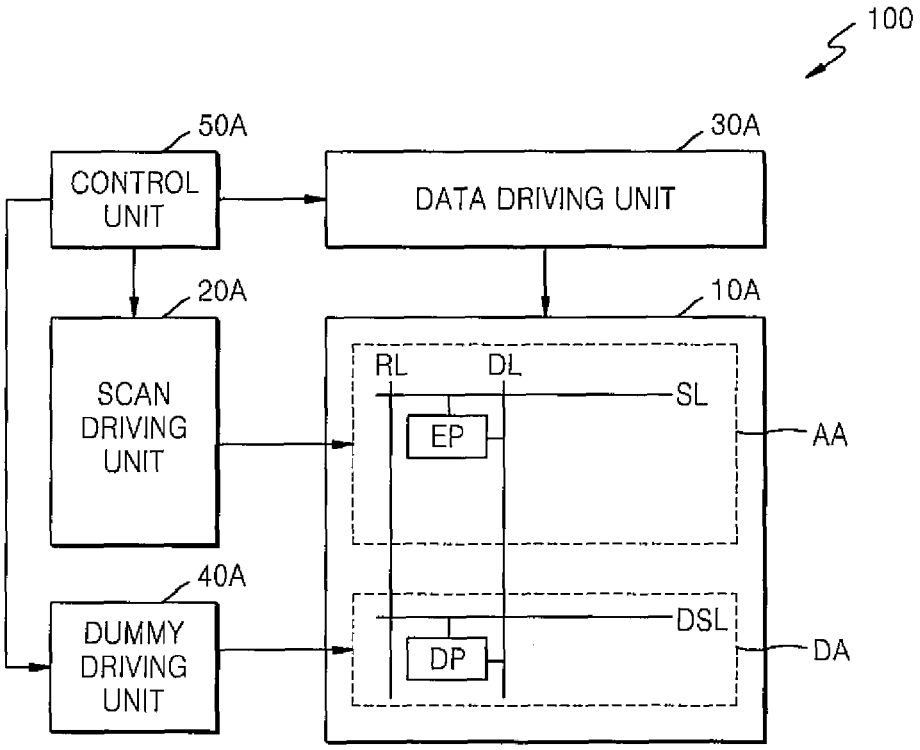
FIG. 1 is a block diagram of a display apparatus, according to an example embodiment of the present invention.

The present invention will now be described more fully with reference to the accompanying drawings, in which example embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Hereinafter, the present invention will be described in detail by explaining example embodiments of the invention with reference to the attached drawings. Like reference numerals in the drawings denote like elements, and thus, their description will not be repeated.

It will be understood that although the terms "first" and "second" are used herein to describe various elements, these elements should not be limited by these terms. These terms are only used to distinguish one element from another element. Thus, a first element discussed below could be termed a second element, and similarly, a second element may be termed a first element without departing from the teachings of this disclosure. As used herein, the singular forms "a", "an" and "the" are intended to include the plural forms as well, unless the context clearly indicates otherwise.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

FIG. 1 is a block diagram of an organic light-emitting display apparatus 100, according to an example embodiment of the present invention.

Referring to FIG. 1, the display apparatus 100 may include a display panel 10A including a plurality of pixels, a scan driver (e.g., scanning driving unit) 20A, a data driver (e.g., data driving unit) 30A, a dummy driver (e.g., dummy driving unit) 40A, and a controller (e.g., control unit) 50A. The scan driver 20A, the data driver 30A, the dummy driver 40A, and the controller 50A are respectively formed as integrated circuit (IC) chips, or collectively formed as a single IC chip and then may be directly mounted on the display panel 10A. Alternatively, the scan driver 20A, the data driver 30A, the dummy driver 40A, and the controller 50A may be mounted on a flexible printed circuit film, attached to the display panel 10A as a tape carrier package, mounted on a separate printed circuit board (PCB), formed on the same substrate as the display panel 10A, and/or the like.

In the display panel 10A, a display area AA and a dummy area DA, which is a portion of a non-display area adjacent to the display area AA, may be formed.

The dummy area DA may be formed on at least one of a top area and a bottom area, or at least one of a left side and a right side of the display area AA. Accordingly, one or more dummy pixels DPs may be formed above or below (e.g., on a top area and/or a bottom area) of each of pixel columns, or may be formed to the right or left (e.g., at a right side and/or a left side) of each of the pixel rows. In the present embodiment, the dummy pixels DPs are formed on each pixel column in the dummy area DA arranged above or below (e.g., on the top area or the bottom area of) the display area AA, although the description of the present embodiment also applies to a case where the dummy pixels DPs are formed on each pixel row in the dummy area DA arranged to the right or left of (e.g., on the left side or the right side) of the display area AA.

The emitting pixels EPs that are electrically coupled to (e.g. connected to) a scanning line SL and a data line DL are arranged in the display area AA, and, at least one dummy pixel DP that is electrically coupled to a dummy scanning line DSL and the data line DL is arranged in the dummy area DA.

The dummy scanning line DSL may be the $n+1^{th}$ scanning line SLn+1, which is adjacent to (e.g., next to) the last $n^{th}$ scanning line SLn of the display area AA, and/or the $0^{th}$ scanning line SL0, which is before the first scanning line SL1 of the display area AA.

In the display panel 10A, a repair line RL may be arranged parallel to the data line SL in each pixel column. The repair line RL couples a light-emitting device, which is separated from (e.g., disconnected from) a defective emitting pixel EP, to the dummy pixel DP, and thus may provide a path (e.g., an electrical path) for controlling light emission of the defective emitting pixel EP based on a logic level of the dummy data signal transmitted to the dummy pixel DP.

Hereinafter, the defective pixels that are to be repaired are referred to as repair pixels EPerr.

In FIG. 1, the data line DL is on one side of (e.g., arranged at a right side of) the emitting pixels EPs and the dummy pixels DPs, and the repair line RL is on another side of (e.g., arranged at a left side of) of the emitting pixels EPs and the dummy pixels DPs. However, the present invention is not limited thereto. Locations of the data line DL and the repair line RL may be switched, or both may be on the same side (e.g., arranged at the right side or the left side). One or more repair lines RLs may be formed in each pixel column. Additionally, the repair line RL may be formed parallel to the scanning line SL according to a pixel design, and thus, one or more repair lines RLs may be formed in each pixel row.

The scan driver 20A may provide the display panel 10A with scanning signals, which are generated at time intervals (e.g., predetermined time intervals), through scanning lines SLs.

The data driver 30A provides a data signal having any one of first and second logic levels to each of the emitting pixels EPs of the display panel 10A through the data lines DLs. The first logic level and the second logic level may each be a high level or a low level.

The data driver 30A receives video data about the emitting pixels EPs of a frame, and extracts gradation (e.g., grey level) from each emitting pixel EP. Then, the extracted gradation may be converted into digital data having a number of bits (e.g., predetermined number of bits). The data driver 30A may provide each emitting pixel EP with each bit included in the digital data as a data signal in each sub-field. A frame is formed of sub-fields, and a display duration of each sub-field may be determined according to a weight (e.g., a predetermined weight).

The display apparatus 100 adjusts a light-emitting time of the light-emitting device in a frame by selective emission by the light-emitting device included in each emitting pixel EP based on the logic level of the data signal provided by the data driver 30A, and thus displaying the gradation. When a data signal having a low level is received, the light-emitting device of each emitting pixel EP emits in a sub-field period (e.g., a sub-field section), and when a data signal having a high level is received, the light-emitting device may be turned off in a sub-field period (e.g., a sub-field section). Alternatively, when the data signal having the high level is received, the light-emitting device of each emitting pixel EP emits in a sub-field period (e.g., a sub-field section), and when the data signal having the low level is received, the light-emitting device may be turned off in a sub-field period (e.g., a sub-field section).

The dummy driver 40A may transmit the scanning signal to the dummy pixels DPs at the time intervals (e.g., predetermined time intervals) through the dummy scanning line DSL. The dummy driver 40A is configured in an external FPCB so that a dummy scanning signal may be transmitted by utilizing (e.g., using) a pad coupled to the dummy scanning line DSL.

In FIG. 1, one scan driver 20A and one dummy driver 40A are illustrated. However, scan drivers 20A may be arranged at both sides of the scanning line SL, and dummy drivers 40A may be arranged at both sides of the dummy scanning line DSL so that a voltage decrease (e.g., a voltage drop) of the scanning signal may be reduced (e.g., minimized) in a direction farther from the scan drivers 20A and the dummy drivers 40A.

When the scanning signal is transmitted to the dummy pixels DPs by the dummy driver 40A, the data driver 30A may transmit the dummy data signal to the dummy pixels DPs.

In an example of a normal operation where the data signal is directly transmitted to the emitting pixels EPs, the data driver 30A may transmit the data signal, which is transmitted or will be transmitted to the emitting pixels EPs that are coupled to the first scanning line SL1 or the last scanning line SLn of the display area AA, to the dummy pixels DPs as the dummy data signal. When a repair operation in which the data signal is transmitted from the dummy pixels DPs to the repair pixels EPerr through the repair line RL is performed, the data driver 30A may transmit the data signal, which is transmitted or will be transmitted to the repair pixels EPerr, to the dummy pixels DPs as the dummy data signal.

The controller 50A generates a scanning control signal, a data control signal, and a dummy control signal, and transmits them to the scan driver 20A, the data driver 30A, and the dummy driver 40A, respectively. Accordingly, the scan driver 20A transmits scanning signals to each scanning line SL at the time intervals (e.g., predetermined time intervals), and the data driver 30A transmits the data signals to each emitting pixel EP. The dummy driver 40A transmits the scanning signals to the dummy scanning line DSL at a time before the first scanning line SL1, or at a time after the last scanning line SLn.

In one embodiment, the dummy driver 40A and the scan driver 20A are physically and functionally separate (e.g., not integrated or separately prepared. However, the present invention is not limited thereto, and the scan driver 20A may perform functions of the dummy driver 40A as well and/or the two units may be integrated as one.

Figure 2:
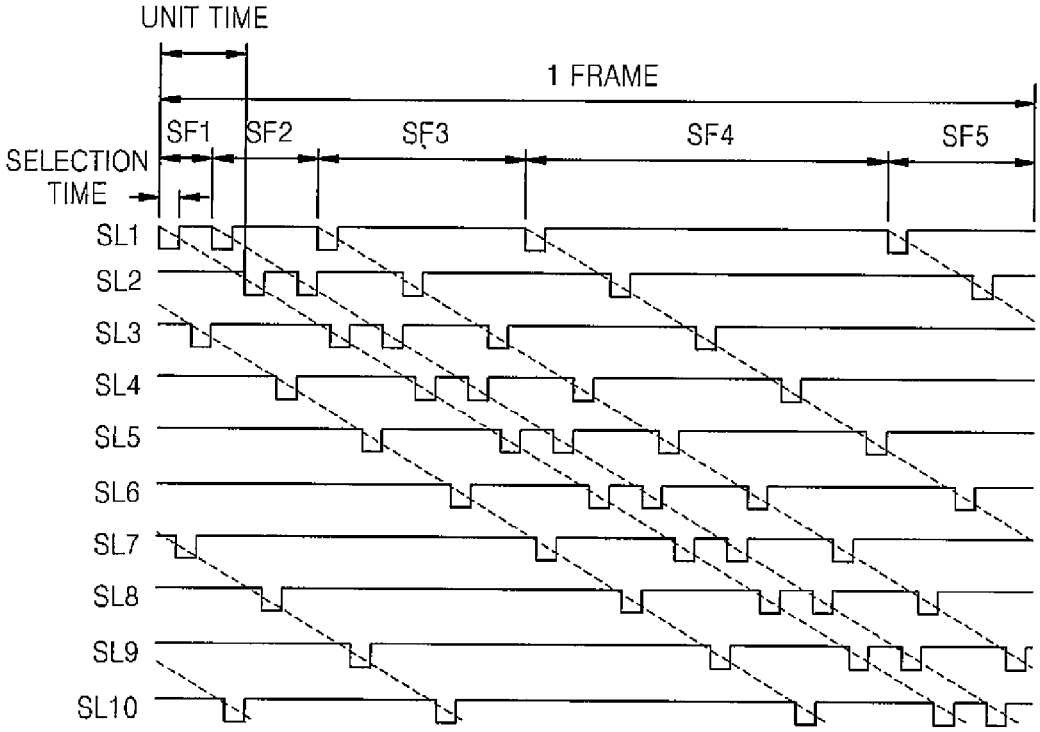
FIGS. 2 and 3 are, a timing diagram and a timing chart, respectively, of driving methods of the display apparatus of FIG. 1, according to example embodiments of the present invention.
Figure 3:
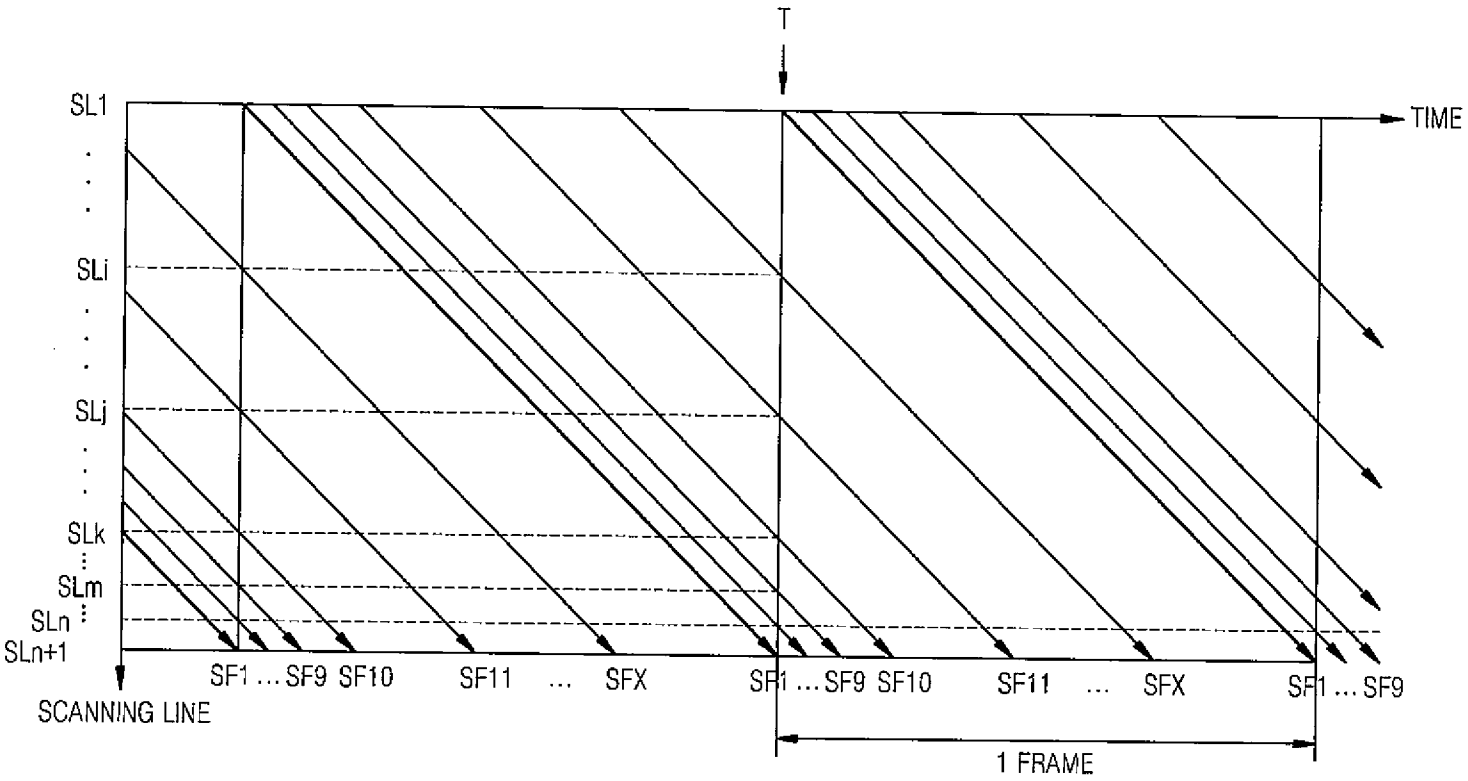

FIGS. 2 and 3 are a timing diagram and a timing chart, respectively, of driving methods of the display apparatus 100 of FIG. 1, according to example embodiments of the present invention.

FIG. 2 illustrates an example in which first through tenth scanning lines SL1 through SL10 are controlled. Referring to FIG. 2, a frame is formed of five sub-fields, which are the first through the fifth sub-fields (SF1 through SF5), and thus gradation (e.g., grey level) is displayed by five bit data from a first bit data to a fifth bit data. Here, the term "bit data" refers to data including one or more bits and represents a particular grey level. A unit time includes five selection times. A length of the display time of each of the five bit data is 3:6:12:21:8 selection times, and a total display time of five bit data is equal to 50 (=3+6+12+21+8) selection times. A time of selecting (e.g., selection timing of) each scanning line in a sub-field may be one unit time later (e.g., longer) than a time of selecting (e.g., selection timing) of a previous scanning line.

In one unit time, five selection times are processed via a time-sharing method to select one scanning line at a time. For example, in a first unit time, the first scanning line SL1 is selected in the first selection time, a seventh scanning line SL7 is selected in a second selection time, a third scanning line SL3 is selected in a third selection time, the first scanning line SL1 is selected in a fourth selection time, and a tenth scanning line SL10 is selected in a fifth selection time in sequence. Thus, first, fourth, fifth, second, and third bit data are transmitted to each of the emitting pixels EPs.

The tenth scanning line SL10 is the dummy scanning line, and when the display panel 10A operates normally without a repair, the bit data that is transmitted to the emitting pixel EP coupled to the first or ninth scanning line SL1 or SL9 in the same pixel column may be transmitted to the dummy pixels DPs in the pixel column at a time of selecting the tenth scanning line SL10.

When one of the dummy pixels DPs coupled to the tenth scanning line SL10 is utilized to (e.g., used to) repair a defective pixel in the same pixel column, the bit data transmitted to the repair pixel EPerr may be transmitted to the dummy pixel DP at the time of selecting the tenth scanning line SL10.

FIG. 3 illustrates an example in which the first scanning line SL1 through the $n+1^{th}$ scanning line SLn+1 are controlled. Referring to FIG. 3, a frame is formed of the first sub-field SF1 through the $X^{th}$ sub-field SFX, and the gradation is displayed by the first bit data through the $X^{th}$ bit data. One unit time includes X selection times. The time of selecting each scanning line in each sub-field is one unit time later (e.g., longer) than the time of selecting the previous scanning line.

The X selection times in the one unit time are processed via the time-sharing method to select one scanning line at a time. In addition, in one selection time when the scanning lines SL1, SU, SLj, SLk, SLm, SLn, and SLn+1 are selected at, for example, time T, it is possible to set the scanning lines to be processed via the time-sharing method.

The last scanning line, the $n+1^{th}$ scanning line SLn+1, is the dummy scanning line, and when the display panel 10A normally operates without a repair, the bit data that is transmitted to the emitting pixel EP coupled to the first scanning line SL1 or the $n^{th}$ scanning line SLn in the same pixel column may be transmitted to the dummy pixel DP at the time of selecting the $n+1^{th}$ scanning line SLn+1.

When the dummy pixel DP coupled to the $n+1^{th}$ scanning line SLn+1 is utilized (e.g., used) in the repair process, the bit data that is transmitted to the repair pixel EPerr in the same pixel column may be transmitted to the dummy pixel DP at the timing of selecting the $n+1^{th}$ scanning line SLn+1.

Figure 4:
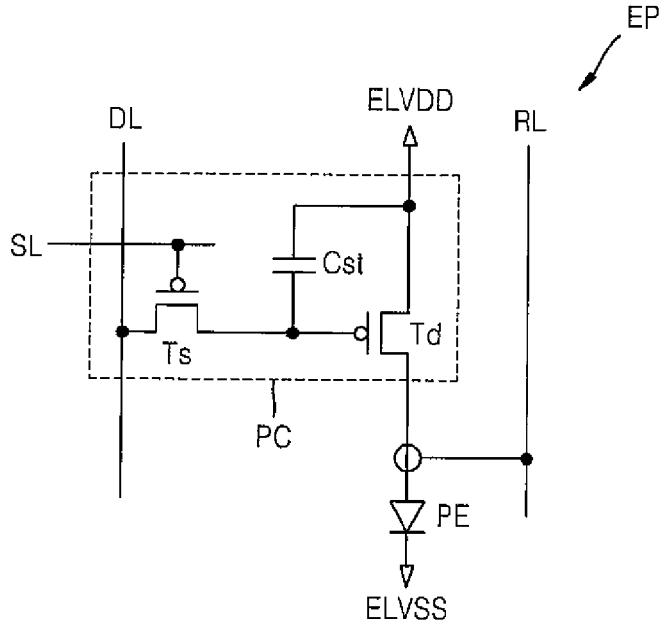
FIG. 4 is a circuit diagram of a structure of an emitting pixel, according to an example embodiment of the present invention.

FIG. 4 is a circuit diagram of a structure of an emitting pixel EP, according to an embodiment of the present invention.

Referring to FIG. 4, the emitting pixel EP includes a driving circuit PC including two transistors, namely, switching and driving transistors Ts and Td, and a capacitor Cst, and a light-emitting device PE electrically coupled to the driving circuit PC.

The light-emitting device PE may be an organic light-emitting diode (OLED) including a first electrode, a second electrode opposite to the first electrode, and an emitting layer located between (e.g., disposed between) the first and second electrodes. The first and second electrodes may be an anode and a cathode, respectively. The anode electrode of the light-emitting device PE is coupled to a second electrode of the driving transistor Td, and the cathode electrode is coupled to a second power line to receive a second source voltage ELVSS. The anode electrode of the light-emitting device PE is insulated from the repair line RL with an insulation layer interposed therebetween. A first source voltage ELVDD may have a high-level voltage, and the second source voltage ELVSS may be lower than the first source voltage ELVDD or may be a ground voltage. The first source voltage ELVDD is a driving voltage and is transmitted to the anode electrode of the light-emitting device PE. The light-emitting device PE emits light when the first source voltage ELVDD is applied to the anode electrode, and when the first source voltage ELVDD is not applied, the light-emitting device PE displays black.

The switching transistor Ts includes a gate electrode coupled to the scanning line SL, a first electrode coupled to the data line DL, and a second electrode coupled to a gate electrode of the driving transistor Td. When the switching transistor Ts is turned on by the scanning signal transmitted to the gate electrode, a data signal transmitted to the data line DL may be transmitted to the gate electrode of the driving transistor Td.

The driving transistor Td includes the gate electrode coupled to the second electrode of the switching transistor Ts, a first electrode coupled to a first power line through which the first source voltage ELVDD is received, and the second electrode coupled to the anode electrode of the light-emitting device PE. The driving transistor Td is turned on or off according to the logic level of the data signal transmitted to the gate electrode, and when the driving transistor Td is turned on, the first source voltage ELVDD is transmitted to the anode electrode of the light-emitting device PE.

The capacitor Cst includes a first electrode coupled to the second electrode of the switching transistor Ts and the gate electrode of the driving transistor Td, and a second electrode coupled to the first power line through which the first source voltage ELVDD is received.

Figure 5:
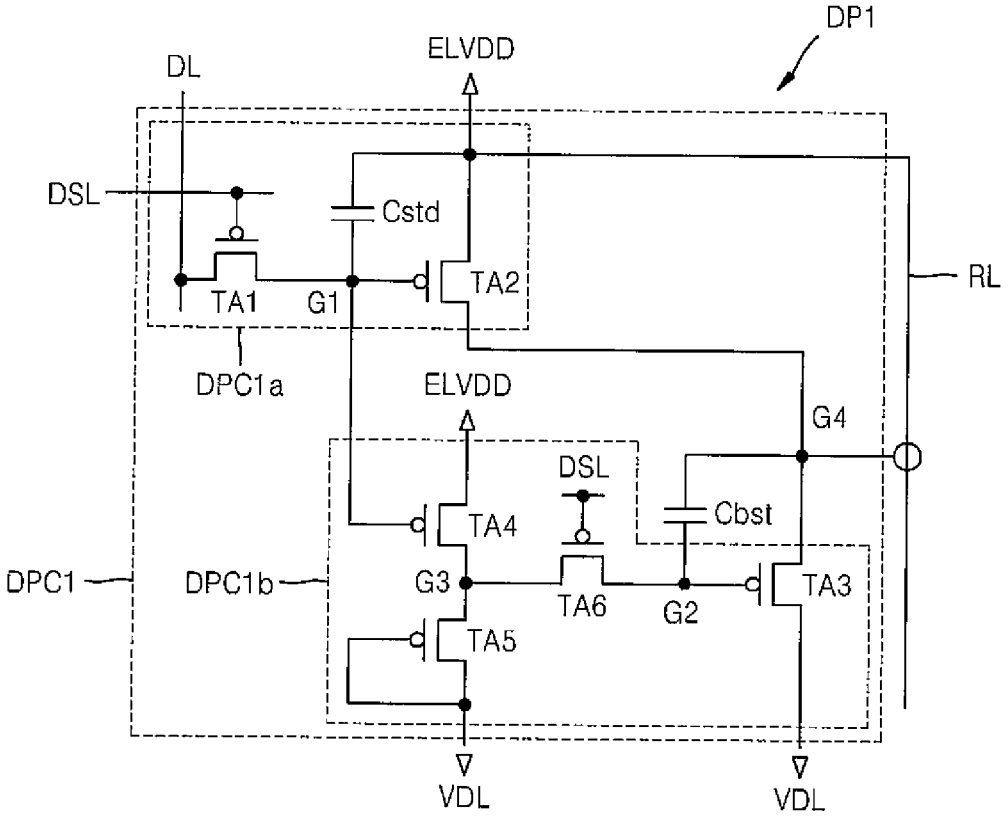
FIG. 5 is a circuit diagram of a structure of a dummy pixel of FIG. 1, according to an example embodiment of the present invention.

FIG. 5 is a circuit diagram of a structure of the dummy pixel DP of FIG. 1, according to an embodiment of the present invention.

Referring to FIG. 5, a dummy pixel DP1 includes a dummy driving circuit DPC1 including first to sixth transistors TA1 to TA6, and two capacitors, namely, dummy and boost capacitors Cstd and Cbst. The repair line RL is coupled to a first power line through which a first source voltage ELVDD is applied, and is insulated from the dummy driving circuit DPC1.

When defective pixels are detected in the display area AA, the dummy driving circuit DPC1 is electrically coupled to a light-emitting device of a defective pixel by the repair line RL and a laser short (e.g., an electrical short created by a laser), and repairs the defective pixels. The dummy driving circuit DPC1 may include a first driving circuit DPC1*a*, a second driving circuit DPC1*b*, and the boost capacitor Cbst.

The first driving circuit DPC1*a* is a charging circuit unit for transmitting a driving voltage to a light-emitting device of a repair pixel EPerr by being activated by any one of the first and second logic levels of the dummy data signal, and charging the repair line RL. The first driving circuit DPC1*a* may charge the repair line RL by being activated in a sub-field period (e.g., a sub-field section; hereinafter, referred to as 'an emitting sub-field period) where a light-emitting device of an emitting pixel is turned on. Charging of the repair line RL may include charging of the repair line RL and a parasitic capacitor in the repair line RL for increasing a voltage level of an anode of the light-emitting device PE to a certain voltage level.

The second driving circuit DPC1*b* is a discharging circuit unit for discharging the repair line RL by being activated by the other of the first and second logic levels of the dummy data signal. The second driving circuit DPC1*b* may discharge the repair line RL by being activated in a sub-field period (e.g., a sub-field section; hereinafter, referred to as 'a non-emitting sub-field period) where a light-emitting device of an emitting pixel is turned off. Discharging (or resetting) of the repair line RL may include the discharging of the repair line RL and the parasitic capacitor for decreasing a voltage level of the anode of the light-emitting device to a certain voltage level.

The boost capacitor Cbst functions as a charging/discharging speed control unit that is coupled to the repair line RL during the charging/discharging of the repair line RL, and may quickly charge/discharge the repair line RL.

Figure 6:
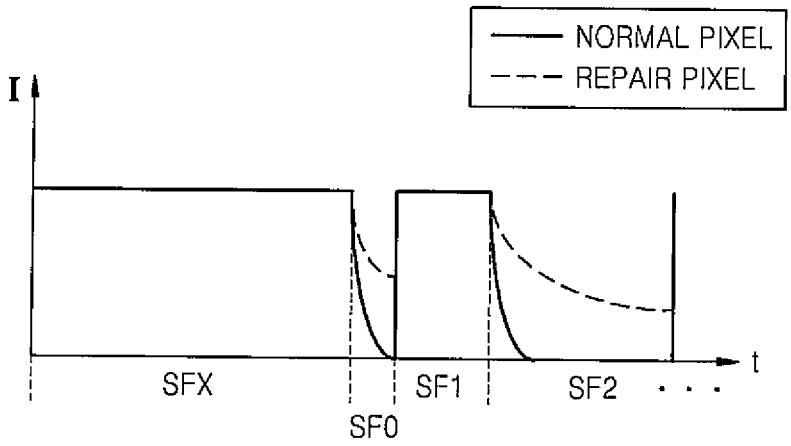
FIG. 6 is a graph illustrating off current that flows through a light-emitting device of a normal emitting pixel, and off current that flows through a light-emitting device of a repair pixel over time, according to an example embodiment of the present invention.

FIG. 6 is a graph illustrating off current that flows through a light-emitting device of a normal emitting pixel EP, and off current that flows through a light-emitting device of a repair pixel EPerr over time, according to an embodiment of the present invention.

In the case of the normal emitting pixel EP, the light-emitting device is discharged (e.g., quickly discharged or discharged fast) during the non-emitting sub-field period, for example, SF0, SF2, etc., current I of the light-emitting device quickly reaches an off level, and thus, the light-emitting device displays black, as illustrated by solid lines of FIG. 6.

On the contrary, in the case of the repair pixel EPerr, the light-emitting device and the repair line RL are not sufficiently discharged (e.g., completely discharged or discharged enough) during the non-emitting sub-field period due to the parasitic capacitor of the repair line RL, as illustrated by dashed curves of FIG. 6. Therefore, the current I of the light-emitting device does not reach the off level in the non-emitting sub-field period, and thus, the repair pixel EPerr may be brighter than the neighboring normal pixel. This phenomenon (e.g., the phenomenon of incomplete discharge) worsens as the sub-field period shortens.

Accordingly, in the present embodiment, the dummy pixel DP includes a boost capacitor whose voltage changes by being coupled to a voltage change according to the charging and discharging of the repair line RL, and thus, the current I of the light-emitting device of the repair pixel EPerr may reach the off level in the non-emitting sub-field period.

The first driving circuit DPC1*a* may include the first transistor TA1, the second transistor TA2, and the dummy capacitor Cstd.

The first transistor TA1 may include a gate electrode coupled to the dummy scanning line DSL, a first electrode coupled to the data line DL, and a second electrode coupled to a first node G1. When the first transistor TA1 is turned on by the scanning signal transmitted to the gate electrode, the first transistor TA1 transmits the dummy data signal that is transmitted to the data line DL to a gate electrode of the second transistor TA2 coupled to the first node G1. The dummy data signal is a data signal transmitted to the repair pixel EPerr.

The second transistor TA2 includes the gate electrode coupled to the first node G1, a first electrode coupled to the first power line from which the first source voltage ELVDD is received, and a second electrode coupled to a fourth node G4 and insulated from the repair line RL by interposing the insulation layer. The second electrode of the second transistor TA2 may be electrically coupled to the repair line RL by a laser short. The second transistor TA2 may be turned on or off according to the logic level of the data signal transmitted to the gate electrode, and when the second transistor TA2 is turned on, the repair line RL coupled to the fourth node G4 is charged so that voltage of the anode electrode of the repair pixel EPerr coupled to the repair line RL may be increased to about the first source voltage ELVDD.

The dummy capacitor Cstd includes a first electrode coupled to the first node G1, and a second electrode coupled to the first power line from which the first source voltage ELVDD is received.

The second driving circuit DPC1*b* may include the third transistor TA3, the fourth transistor TA4, the fifth transistor TA5, and the sixth transistor TA6.

The third transistor TA3 includes a gate electrode coupled to a second node G2, a first electrode coupled to the fourth node G4 and insulated from the repair line RL with the insulation layer interposed therebetween, and a second electrode coupled to a third power line providing a third source voltage VDL. The third source voltage VDL is a voltage of a certain level that may turn on transistors with a lower voltage than the first source voltage ELVDD. The third source voltage VDL may be the same as or different from the second source voltage ELVSS. The first electrode of the third transistor TA3 may be electrically coupled to the repair line RL by a laser short. The third transistor TA3 may be turned on or off according to the logic level of a voltage applied to the second node G2. The third transistor TA3 coupled to the repair line RL is turned off in the emitting sub-field period, and blocks the second driving circuit DPC1*b* from the repair line RL. Then, the third transistor TA3 is turned on in the non-emitting sub-field period, and couples the second driving circuit DPC1*b* to the repair line RL to discharge the same.

The fourth transistor TA4 includes a gate electrode coupled to the first node G1, a first electrode coupled to the first power line from which the first source voltage ELVDD is received, and a second electrode coupled to a third node G3. The fourth transistor TA4 may be turned on or off according to the logic level of the dummy data signal transmitted to the first node G1. When the fourth transistor TA4 is turned on, the first source voltage ELVDD is transmitted to the third node G3.

The fifth transistor TA5 includes a first electrode coupled to the third node G3, and a gate electrode and a second electrode coupled to the third power line from which the third source voltage VDL is received. The fifth transistor TA5 is in a diode-connected configuration (e.g., has a diode-connected structure). The fifth transistor TA5 transmits the third source voltage VDL to the third node G3 when the fourth transistor TA4 is turned off.

The sixth transistor TA6 includes a gate electrode coupled to the dummy scanning line DSL, a first electrode coupled to the third node G3, and a second electrode coupled to the second node G2. When the sixth transistor TA6 is turned on by responding to the scanning signal transmitted to the gate electrode, the sixth transistor TA6 transmits a voltage of the third node G3 to the second node G2 so as to control the turning on or off of the third transistor TA3.

The boost capacitor Cbst includes a first electrode coupled to the second node G2, and a second electrode coupled to the fourth node G4 and insulated from the repair line RL by interposing the insulation layer. When the repair line RL is charged or discharged, the voltage of the boost capacitor Cbst may increase or decrease based on (e.g., according to) an increase or decrease of the voltage of the repair line RL, and the boost capacitor Cbst may maintain a voltage level of the gate electrode of the third transistor TA3 that turns on or off the third transistor TA3.

For example, as the voltage of the repair line RL is decreased due to the discharge of the repair line RL in the non-emitting sub-field period, the boost capacitor Cbst decreases a voltage of the second node G2 by being capacitively coupled to the parasitic capacitor of the repair line RL. Thus, the boost capacitor Cbst turns on (e.g., surely turns on) the third transistor TA3 by decreasing the voltage level of the gate electrode of the third transistor TA3. Accordingly, the repair line RL may be discharged (e.g., quickly discharged or discharged fast) through the third transistor TA3.

Further, the boost capacitor Cbst increases the voltage of the second node G2, by being capacitively coupled to the parasitic capacitor of the repair line RL, according to the voltage of the repair line RL that is increased due to the charge of the repair line RL in the emitting sub-field period. Thus, the boost capacitor Cbst may turn off (e.g., surely turn off) the third transistor TA3 by increasing the voltage level of the gate electrode of the third transistor TA3. Therefore, the repair line RL may be charged (e.g., quickly charged or charged fast) through the second transistor TA2, and then the first source voltage ELVDD may be transmitted to the anode electrode of the repair pixel EPerr.

Figure 7:
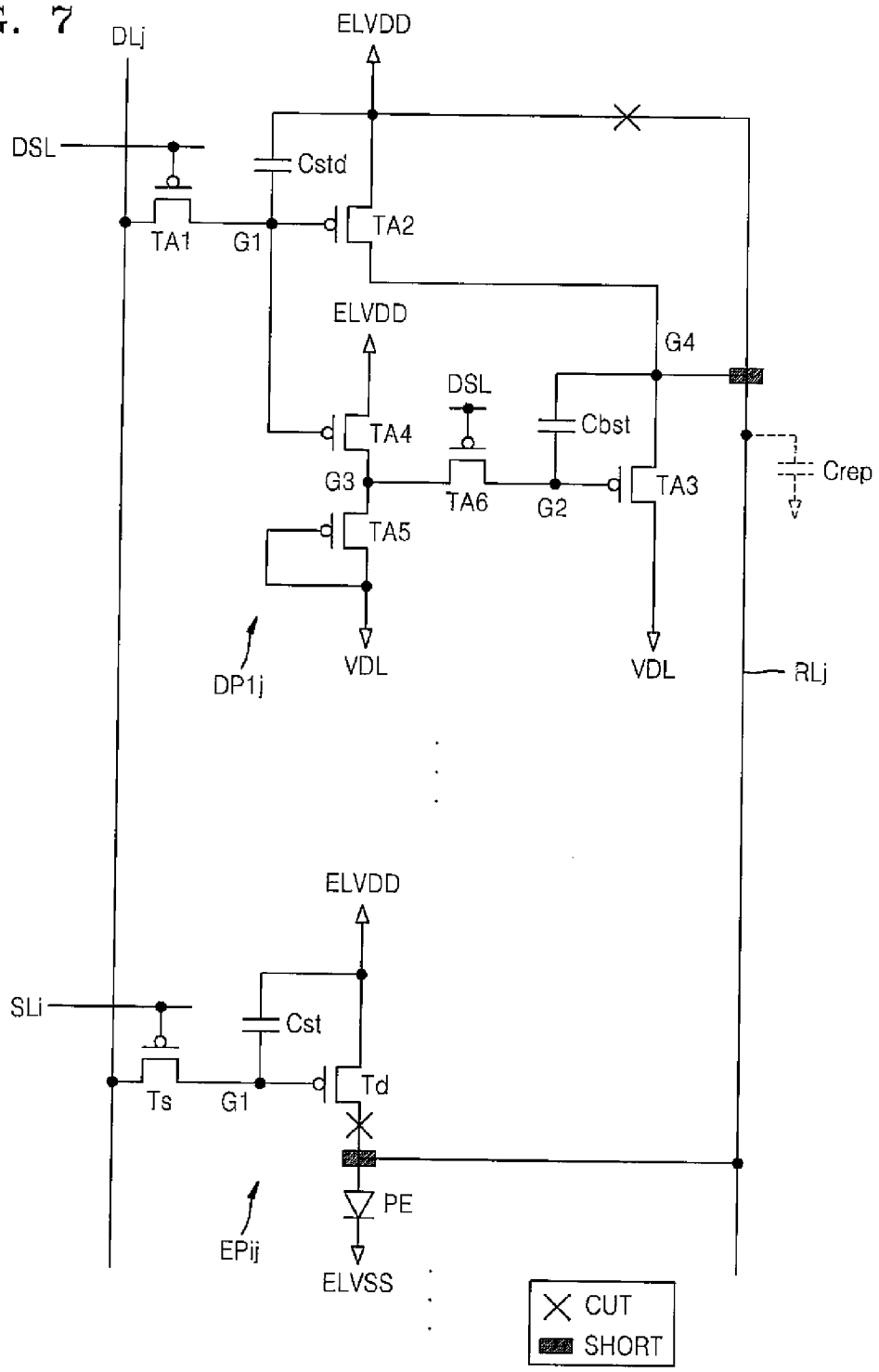
FIG. 7 is a circuit diagram for repairing a defective pixel by utilizing the dummy pixel of FIG. 5, according to an example embodiment of the present invention.

FIG. 7 is a circuit diagram for repairing a defective pixel by utilizing (e.g., using) the dummy pixel DP1 of FIG. 5, according to an embodiment of the present invention.

Referring to FIG. 7, there is a repair pixel EPij at a $j^{th}$ pixel column and an $i^{th}$ pixel row, and a dummy pixel DP1*j* at the $j^{th}$ pixel column and the $0^{th}$ or $n+1^{th}$ pixel row.

A light-emitting device PE of the repair pixel EPij is separated from the repair pixel EPij, and is electrically coupled to a repair line RLj. For example, a laser beam is projected to an area where the anode electrode of the light-emitting device PE and the second electrode of the driving transistor Td are coupled to each other, to separate the light-emitting device PE of the repair pixel EPij from the repair pixel EPij. The anode electrode may be electrically coupled to the repair line RLj by a laser short (e.g., an electrical short created by a laser) in an area in which the anode electrode and the repair line RLj overlap.

The repair line RLj is separated from the first power line in the dummy area DA. Then, the fourth node G4 of the dummy pixel DP1*j* is electrically coupled to the repair line RLj. For example, a laser beam is projected to an area in which the repair line RLj and the first power line overlap to separate the same. Then, the fourth node G4 may be electrically coupled to the repair line RLj by a laser short.

Hereinafter, operations of the repair pixel EPij and the dummy pixel DP1*j* will be described.

When a scanning signal having a low level is transmitted to the dummy pixel DP1*j* in the sub-field period from the dummy scanning line DSL, the first and sixth transistors TA1 and TA6 are turned on. Then, the dummy data signal is transmitted to the data line DL. The dummy data signal is a signal that is transmitted or will be transmitted to the repair pixel EPij.

A case where a logic level of the dummy data signal is a low level will be explained first.

When the dummy data signal is at the low level, the second and fourth transistors TA2 and TA4 are turned on. When the fourth transistor TA4 is turned on, the first source voltage ELVDD, which is at a high level, is transmitted to the third node G3, the first source voltage ELVDD of the third node G3 is transmitted to the gate electrode of the third transistor TA3 through the sixth transistor TA6 that is turned on. The repair line RLj is charged by the second transistor TA2 that is turned on, and the first source voltage ELVDD having the high level is transmitted to the anode electrode of the repair pixel EPij through the repair line RLj.

As a portion of current that flows through the fourth transistor TA4 flows through the fifth transistor TA5, the third node G3 may have a lower voltage level than the first source voltage ELVDD. As a result, the second node G2 may have a lower voltage level than the first source voltage ELVDD so that the third transistor TA3 may be turned on.

When the dummy scanning signal is transmitted at the high level, the first and fourth transistors TA1 and TA4 may be turned off. The first node G1 is floated, and the repair line RLj continues to be charged by the second transistor TA2. As the repair line RLj is charged, the voltage of the repair line RLj increases, and due to the capacitive coupling of a parasitic capacitor Crep of the repair line RLj and the boost capacitor Cbst, the voltage of the second node G2 increases. Therefore, the second node G2 has the first source voltage ELVDD, and the second node G2 may keep the third transistor TA3 off. That is, in the emitting sub-field period, the third transistor TA3 is turned off (e.g., surely turned off) by the boost capacitor Cbst, and the first source voltage ELVDD that is transmitted by the second transistor TA2 may be transmitted to the anode electrode of the repair pixel EPij through the repair line RLj. The light-emitting device PE of the repair pixel EPij may emit light due to the first source voltage ELVDD transmitted to the anode electrode thereof.

Next, a case where the logic level of the dummy data signal is at the high level will be explained.

When the dummy data signal is at the high level, the second and fourth transistors TA2 and TA4 may be turned off. When the fourth transistor TA4 is turned off, the third source voltage VDL, which is at a low level, is transmitted to the third node G3 through the fifth transistor TA5, and the third source voltage VDL of the third node G3 is transmitted to the gate electrode of the third transistor TA3 through the sixth transistor TA6 that is turned on. Because the third transistor TA3 is turned on and the second transistor TA2 is turned off, the repair line RLj is discharged through the third transistor TA3.

As the voltage of the second node G2 is increased to a higher level than the third source voltage VDL, that is, VDL+$|V_{th}6|$, the third transistor TA3 may not be completely turned off.

When the dummy scanning signal is transmitted at the high level, the first and sixth transistors TA1 and TA6 may be turned off. The first node G1 is floated, and the second transistor TA2 remains off. As the repair line RLJ continues to be discharged, the voltage of the repair line RLj decreases, and thus, the voltage of the second node G2 decreases due to the capacitive coupling of the parasitic capacitor Crep of the repair line RLJ and the boost capacitor Cbst. Therefore, the second node G2 has the third source voltage VDL, and thus, the third transistor TA3 may remain on. That is, as the third transistor TA3 is turned on (e.g., surely turned on) by the boost capacitor Cbst in the non-emitting sub-field period, the repair line RLj may be discharged (e.g., quickly discharges) through the third transistor TA3. Because current of the light-emitting device PE of the repair pixel EPij may reach (e.g., quickly reach) the off level, the repair pixel EPij may normally display black without a difference in brightness in neighboring pixels.

Figure 8:
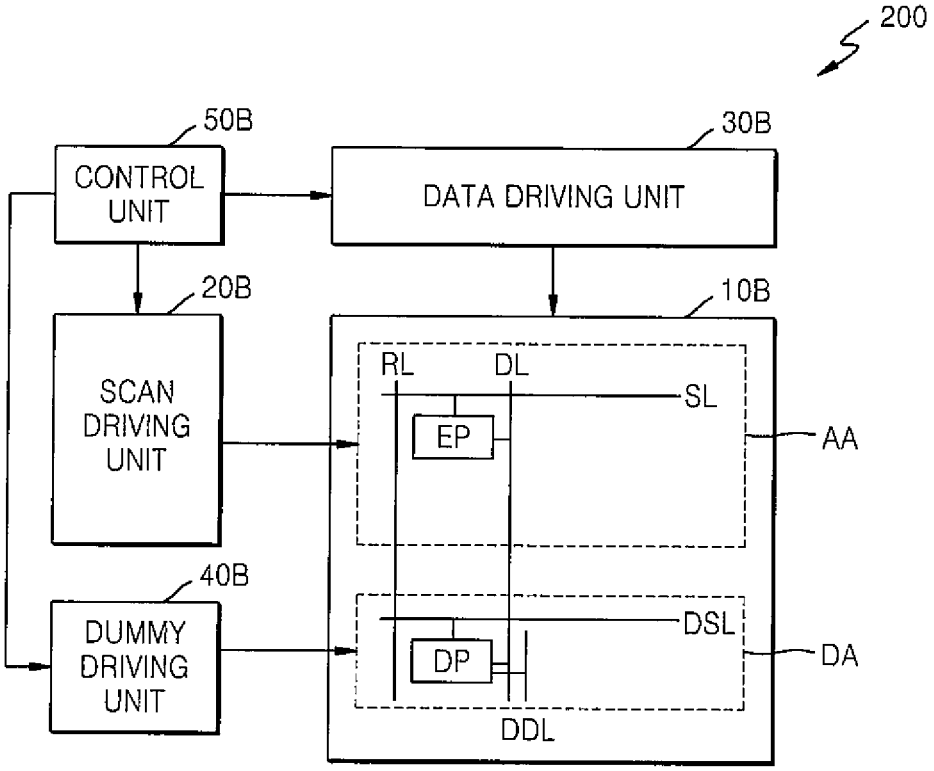
FIG. 8 is a schematic block diagram of a display apparatus, according to another example embodiment of the present invention.

FIG. 8 is a schematic block diagram of a display apparatus 200, according to another embodiment of the present invention.

Referring to FIG. 8, the display apparatus 200 includes a display panel 10B including pixels, a scan driver (e.g., scanning driving unit) 20B, a data driver (e.g., data driving unit) 30B, a dummy scan driver 40B, and a controller (e.g., control unit) 50B.

Hereinafter, descriptions of the display apparatus 200 will be provided by focusing on differences from the display apparatus 100 of FIG. 1, and detailed descriptions about the same structure may not be repeated. The display apparatus 200 of FIG. 8 may operate according to the methods of FIGS. 2 and 3.

In a display area AA, emitting pixels EPs that are coupled to a scanning line and a data line DL are arranged.

In a dummy area DA, at least one dummy pixel DP that is coupled to a dummy scanning line DSL, the data line DL, and a dummy data line DDL is arranged. The dummy area DA may be formed on at least one of a top area and a bottom area, or at least one of a left side and a right side of the display area AA. In the present embodiment, a case where the at least one dummy pixels DP is formed on each of pixel columns in the dummy area DA arranged on at least one of the top area and the bottom area of the display area AA is illustrated, and the description of the present embodiment also applies to an embodiment in which the at least one dummy pixel DP is formed on each of pixel rows in the dummy area DA arranged on at least one of the left side and the right side of the display area AA.

The scan driver 20B generates and transmits the scanning signal to the display panel 10B through scanning lines SL at time intervals (e.g., predetermined time intervals).

The data driver 30B transmits the data signal having any one of a first logic level or a second logic level to the emitting pixels EPs, and transmits the dummy data signal to the dummy pixels DPs. The dummy data signal may be a data signal that is transmitted or will be transmitted to repair pixels EPerr.

The dummy driver 40B may transmit the scanning signal to the dummy pixels DPs through the dummy scanning line DSL at the intervals of the predetermined timing. The dummy scanning line DSL may be the $n+1^{th}$ scanning line SLn+1 after the $n^{th}$ scanning line SLn of the display area AA and/or may be the $0^{th}$ scanning line SL0 before a first scanning line SL1. Additionally, the dummy driver 40B may transmit a reverse data signal that is opposite to (e.g., reverse or inverse of) the dummy data signal to the dummy data line DDL.

Figure 9:
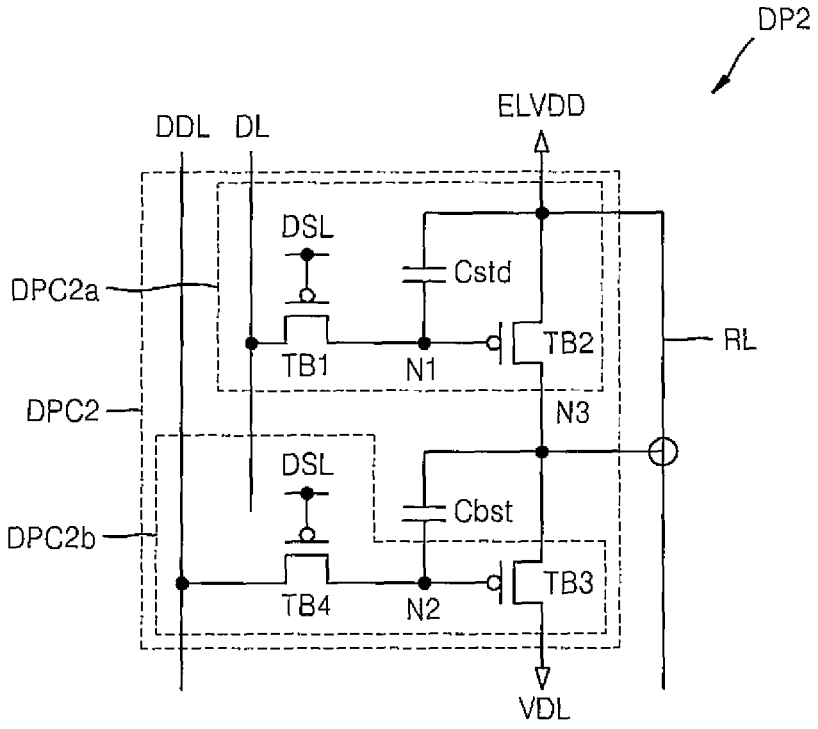
FIG. 9 is a circuit diagram of a structure of a dummy pixel of FIG. 8, according to an example embodiment of the present invention.

FIG. 9 is a circuit diagram of a structure of the dummy pixel DP of FIG. 8, according to an embodiment of the present invention.

Referring to FIG. 9, A dummy pixel DP2 includes a dummy driving circuit DPC2 including first through fourth transistors TB1 through TB4, and two capacitors, namely, dummy and boost capacitors Cstd and Cbst. The repair line RL is coupled to a first power line transmitting a first source voltage ELVDD, and is insulated from the dummy driving circuit DPC2. The dummy pixel DP2 is coupled to the data line DL and the dummy data line DDL.

When a defective pixel is detected in the display area AA, the dummy driving circuit DPC2 is coupled to the repair line RL by a laser short (e.g., an electrical short created by a laser), and then is electrically coupled to a light-emitting device of the defective pixel to repair the same. The dummy driving circuit DPC2 may include a first driving circuit DPC2*a*, a second driving circuit DPC2*b*, and the boost capacitor Cbst.

The first driving circuit DPC2*a* is a charge circuit unit for charging the repair line RL by being activated by one of the first logic level and the second logic level of the dummy data signal, and transmitting a driving voltage to a light-emitting device of a repair pixel EPerr. The first driving circuit DPC2*a* may charge the repair line RL by being activated in an emitting sub-field period.

The second driving circuit DPC2*b* is a discharge circuit unit for discharging the repair line RL by being activated by the other of the first and second logic levels of the dummy data signal. The second driving circuit DPC2*b* may discharge the repair line DL by being activated in a non-emitting sub-field period.

The boost capacitor Cbst functions as a charge/discharge speed control unit that is coupled to the repair line RL when charging or discharging the repair line RL, and charges/discharges (e.g., quickly charges/discharges) the repair line RL.

The first driving circuit DPC2*a* may include the first transistor TB1, the second transistor TB2, and the dummy capacitor Cstd.

The first transistor TB1 includes a gate electrode coupled to the dummy scanning line DSL, a first electrode coupled to the data line DL, and a second electrode coupled to a first node N1. When the first transistor TB1 is turned on by the scanning signal transmitted to the gate electrode of the first transistor TB1, the first transistor TB1 transmits the dummy data signal, which is transmitted to the data line DL, to a gate electrode of the second transistor TB2 that is coupled to the first node N1. The dummy data signal is a data signal transmitted to the repair pixels EPerr.

The second transistor TB2 includes the gate electrode coupled to the first node N1, a first electrode coupled to the first power line from which the first source voltage EVLDD is received, and a second electrode coupled to a third node N3 and insulated from the repair line RL by interposing an insulation layer. The second electrode of the second transistor TB2 may be electrically coupled to the repair line RL by a laser short. The second transistor TB2 may be turned on or off according to the logic level of the dummy data signal transmitted to the data electrode, and when the second transistor TB2 is turned on, the second transistor TB2 charges the repair line RL coupled to the third node N3 so as to transmit the first source voltage ELVDD to the anode electrode of the repair pixel EPerr through the repair line RL.

The dummy capacitor Cstd includes a first electrode coupled to the first node N1, and a second electrode coupled to the first power line from which the first source voltage ELVDD is received.

The second driving circuit DPC2*b* may include the third transistor TB3 or the fourth transistor TB4.

The third transistor TB3 includes a gate electrode coupled to a second node N2, a first electrode coupled to the third node N3, and a second electrode coupled to a third power line providing a third source voltage VDL. The first electrode of the third transistor TB3 is insulated from the repair line RL by interposing the insulation layer. The first electrode of the third transistor TB3 may be electrically coupled to the repair line RL by a laser short. The third transistor TB3 may be turned on or off according to a logic level of a voltage applied to the second node N2. The third transistor TB3 coupled to the repair line RL is turned off in the emitting sub-field period to block the repair line RL from the second driving circuit DPC2*b*, and is turned on in the non-emitting sub-field period to discharge the repair line RL by coupling (e.g., connecting) the second driving circuit DPC2*b* and the repair line RL.

The fourth transistor TB4 includes a gate electrode coupled to the dummy scanning line DSL, a first electrode coupled to the dummy data line DDL, and a second electrode coupled to the second node N2. When the fourth transistor TB4 is turned on by responding to the scanning signal transmitted to the gate electrode, the fourth transistor TB4 transmits the reverse data signal transmitted to the dummy data line DDL to the gate electrode of the fourth transistor TB4, which is coupled to the second node N2 so as to control the third transistor TB3 to be turned on or off. The reverse data signal is a reverse signal of the data signal.

The boost capacitor Cbst includes a first electrode coupled to the second node N2, and a second electrode coupled to the third node N3 and insulated from the repair line RL by interposing the insulation layer. When the repair line RL is charged or discharged, the voltage of the boost capacitor Cbst increases or decreases according to the increase or decrease in the voltage of the repair line RL, and thus, the boost capacitor Cbst may maintain the voltage level of the gate electrode that turns on or off the third transistor TB3.

In particular, because the boost capacitor Cbst is capacitively coupled to a parasitic capacitor of the repair line RL and decreases the voltage of the second node N2 as the voltage of the repair line RL decreases due to the discharge of the repair line RL in the non-emitting sub-field period, the voltage level of the gate electrode of the third transistor TB3 may be decreased to turned off (e.g., surely turn off) the third transistor TB3. Accordingly, the repair line RL may be discharged (e.g., quickly discharged) through the third transistor TB3.

Further, because the boost capacitor Cbst is capacitively coupled to the parasitic capacitor of the repair line RL and Increases the voltage of the second node N2 as the voltage of the repair line RL increases due to the charge of the repair line RL in the emitting sub-field period, the voltage level of the gate electrode of the third transistor TB3 may be increased to turned off (e.g., surely turn off) the third transistor TB3. Accordingly, the repair line RL may be charged (e.g., quickly charged) through the second transistor TB2, and the first source voltage ELVDD may be transmitted to the anode electrode of the repair pixel EPij.

Figure 10:
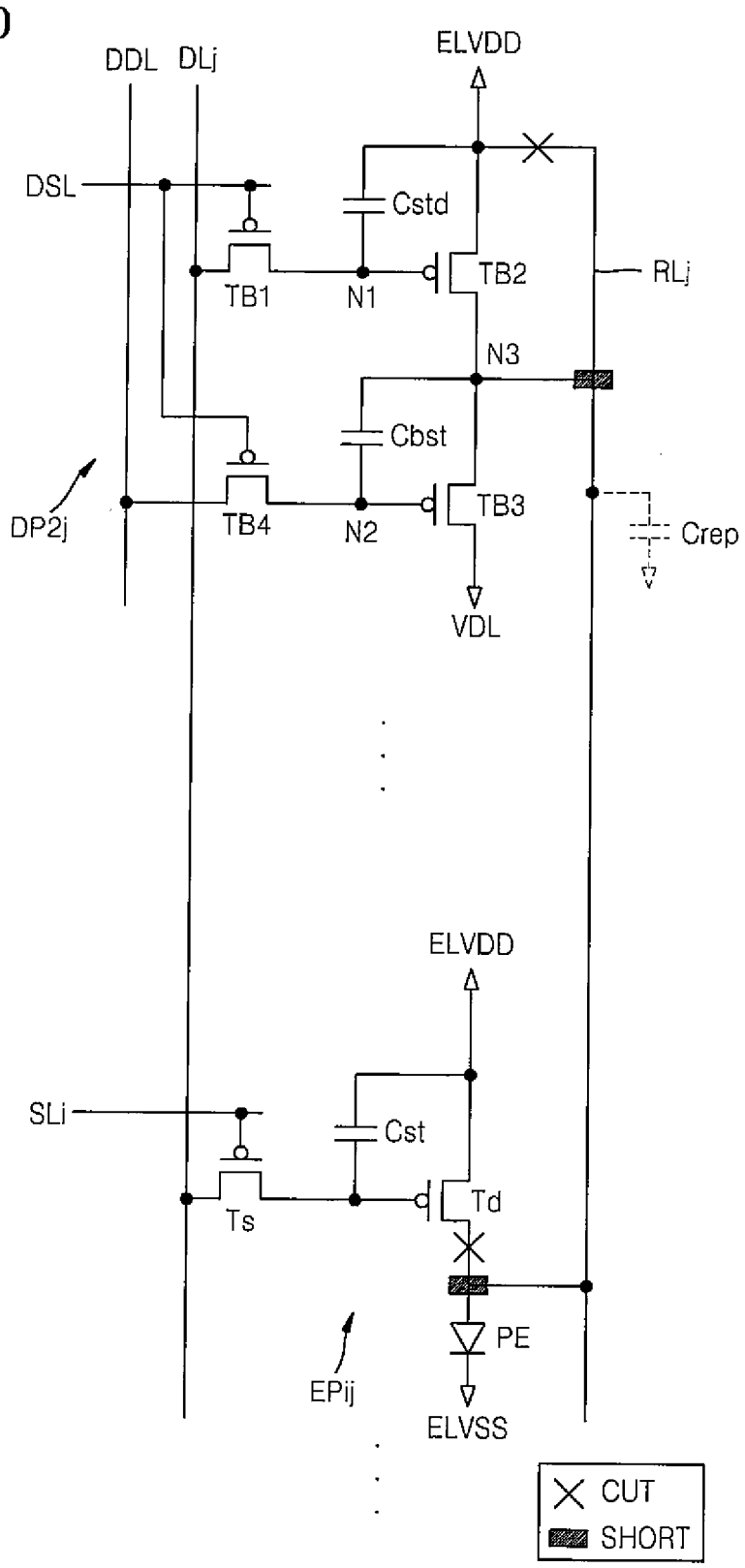
FIG. 10 is a circuit diagram of a method of repairing a defective pixel by utilizing the dummy pixel of FIG. 9, according to an example embodiment of the present invention.

FIG. 10 is a circuit diagram of a method of repairing a defective pixel by utilizing (e.g., using) the dummy pixel DP2 of FIG. 9, according to an embodiment of the present invention.

Referring to FIG. 10, a repair pixel EPij coupled to the repair line RLj at the $j^{th}$ pixel column and the $i^{th}$ pixel row, and a dummy pixel DP2*j* at the jth pixel column and the $0^{th}$ or $n+1^{th}$ pixel row will be described.

A light-emitting device PE of the repair pixel EPij is separated from the repair pixel EPij, and is electrically coupled to the repair line RLj. For example, a laser beam is incident on (e.g., projected to) an area where the anode electrode of the light-emitting device PE and the second electrode of the driving transistor Td are coupled, to separate the light-emitting device PE and the second electrode of the driving transistor Td. The anode electrode and the repair line RLj may be electrically coupled by a laser short (e.g., an electrical short created by a laser) in an area in which the anode electrode and the repair line RLj overlap.

The repair line RLj is separated from the first power line in the dummy area DA. Then, the third node N3 of the dummy pixel DPj is electrically coupled to the repair line RLj. For example, a laser beam is shone on (e.g., projected to) an area where the repair line RLj and the first power line overlap, and thus, a connection of the repair line RLj and the first power line may be cut. The third node N3 may be electrically coupled to the repair line RLj by a laser short.

Hereinafter, operations of the repair pixel EPij and the dummy pixel DP2*j* will be explained.

When the scanning signal having a low level is transmitted from the dummy scanning line DSL to the dummy pixel DP2*j* in each sub-field period, the first and third transistors TB1 and TB3 may be turned on. Then, the dummy data signal is transmitted to the data line DL, and the reverse data signal is transmitted to the dummy data line DDL. The dummy data signal is a data signal that is transmitted or will be transmitted to the repair pixel EPij. The reverse data signal is a reverse signal of the dummy data signal.

A case where the logic level of the dummy data signal is a low level will be described first.

When the dummy data signal has a low level, the reverse data signal has a high level. The third transistor TB3 is turned on due to the reverse data signal having the high level. The second transistor TB2 is turned on due to the dummy data signal having the low level. As the repair line RLj is charged by the second transistor TB2 that is turned on, the first source voltage ELVDD having the high level is transmitted to the anode electrode of the repair pixel EPij through the repair line RLj.

When the dummy scanning signal is transmitted at the high level, the first and fourth transistors TB1 and TB4 are turned off. The first node N1 is floated, and the repair line RLj continues to be charged by the second transistor TB2. As the repair line RLj is charged, the voltage of the repair line RLj increases, and accordingly, the voltage of the second node N2 is increased by capacitive coupling of the parasitic capacitor Crep of the repair line RLj and the boost capacitor Cbst. Therefore, the third transistor TB3 may remain off. That is, in the emitting sub-field period, the third transistor TB3 is turned off (e.g., surely turned off) by the boost capacitor Cbst, and thus, the first source voltage ELVDD transmitted by the second transistor TB2 may be transmitted to the anode electrode of the repair pixel EPij through the repair line RLj. The light-emitting device PE of the repair pixel EPij may emit light due to the first source voltage ELVDD transmitted to the anode electrode thereof.

Hereinafter, a case where the logic level of the dummy data signal is a high level will be described.

Because the dummy data signal has a high level, the reverse data signal is at a low level. The second transistor TB2 is turned off by the dummy data signal having the high level. The third transistor TB3 is turned on by the reverse data signal having the low level. Because the third transistor TB3 is turned on and the second transistor TB2 is turned off, the repair line RLj is discharged through the third transistor TB3.

When the dummy scanning signal is transmitted at the high level, the first and fourth transistors TB1 and TB4 are turned off. The first node N1 is floated, and the second transistor TB2 remains off. As the repair line RLj continues to be discharged, the voltage of the repair line RLj is decreased, and accordingly, the voltage of the second node N2 is decreased due to the capacitive coupling of the parasitic capacitor Crep of the repair line RLj and the boost capacitor Cbst. Therefore, the third transistor TB3 may remain on. That is, in the non-emitting sub-field period, the repair line RLj may be discharged (e.g., quickly discharged) through the third transistor TB3 by turning on (e.g., surely turning on) the third transistor TB3 via the boost capacitor Cbst. Current of the light-emitting device PE of the repair pixel EPij may reach (e.g., quickly reach) the off level, and thus, the repair pixel EPij may display black normally without a difference in brightness in neighboring pixels.

As described above, the repair line exhibits a parasitic capacitance, and thus, the charge or discharge of the repair line may entail (e.g., may be performed along with) charge or discharge of the parasitic capacitor of the repair line.

In the above embodiments, emitting pixels EPs and dummy pixels DPs are formed of p-type transistors, however, the present invention is not limited thereto. Pixels may be formed of n-type transistors, in which case, the pixels may operate according to signals of a reverse level.

As described above, according to the one or more of the above embodiments of the present invention, defective pixels may be repaired (e.g., easily repaired) when they are detected, and thus a production yield of a display apparatus may be improved by operating the defective pixels normally.

While one or more embodiments of the present invention have been described with reference to the figures, it will be understood by those of ordinary skill in the art that various suitable changes in form and details may be made therein without departing from the spirit and scope of the present invention as defined by the following claims and equivalents thereof.

What is claimed is:

1. An organic light-emitting display apparatus comprising:

a plurality of emitting pixels each comprising a light-emitting device and a driver configured to display a gradation by enabling the light-emitting device to selectively emit light according to a logic level of a data signal transmitted corresponding to each of a plurality of sub-fields forming a frame; and dummy pixels coupled to a repair line, the repair line being coupled to a light-emitting device of a first emitting pixel from among the plurality of emitting pixels, wherein each of the dummy pixels comprises:

a first dummy driver configured to make the light-emitting device of the first emitting pixel emit light by charging the repair line when a data signal having a first logic level is transmitted;

a second dummy driver configured to discharge the repair line when a data signal having a second logic level opposite to the first logic level is transmitted; and a boost capacitor configured to control a charging and/or discharging speed of the repair line, the boost capacitor being coupled to the repair line.

2. The organic light-emitting display apparatus of claim 1, wherein the first dummy driver comprises:

a first transistor configured to be turned on by a scanning signal and to receive the data signal;

a second transistor configured to be turned on by the data signal having the first logic level and to transmit a first source voltage to the light-emitting device of the first emitting pixel; and a dummy capacitor configured to store a voltage that corresponds to the data signal.

3. The organic light-emitting display apparatus of claim 1, wherein the second dummy driver comprises a third transistor configured to block a connection of the second dummy driver to the repair line by being off when the data signal having the first logic level is transmitted to the first dummy driver, and to discharge the repair line after coupling the second dummy driver to the repair line by being on when the data signal having the second logic level is transmitted to the first dummy driver, wherein the boost capacitor is coupled between the third transistor and the repair line.

4. The organic light-emitting display apparatus of claim 3, further comprising:

a fourth transistor configured to transmit a first source voltage to a first node by being on when the data signal having the first logic level is transmitted to the first dummy driver;

a fifth transistor configured to transmit a second source voltage to the first node when the data signal having the second logic level is transmitted to the first dummy driver, the second source voltage being lower than the first source voltage; and a sixth transistor configured to turn on by a scanning signal, to turn off the third transistor when a voltage of the first node is at the first source voltage, and to turn on the third transistor when the voltage of the first node is at the second source voltage.

5. The organic light-emitting display apparatus of claim 3, wherein the second dummy driver further comprises a fourth transistor configured to turn on by a scanning signal, to turn on the third transistor by receiving a reverse data signal having the first logic level when the data signal having the second logic level is transmitted to the first dummy driver, and to turn off the third transistor by receiving a reverse data signal having the second logic level when the data signal of the first logic level is transmitted to the first dummy driver.

6. The organic light-emitting display apparatus of claim 3, wherein when the repair line is charged or discharged, a voltage of the boost capacitor respectively increases or decreases as a voltage of the repair line increases or decreases, and the boost capacitor maintains a voltage level of a gate electrode of the third transistor to turn on or off the third transistor.

7. The organic light-emitting display apparatus of claim 1, wherein the drivers of the emitting pixels comprise:

a switching transistor configured to turn on by a scanning signal and to receive the data signal;

a driving transistor configured to turn on or off according to the logic level of the data signal; and a capacitor configured to store a voltage corresponding to the data signal.

8. The organic light-emitting display apparatus of claim 1, wherein the light-emitting device of the first emitting pixel is separated from the drivers and coupled to the repair line.

9. The organic light-emitting display apparatus of claim 1, wherein the emitting pixels are in a display area, and the dummy pixels are in a dummy area adjacent to the display area.

10. The organic light-emitting display apparatus of claim 1, wherein the dummy pixels are coupled to a dummy scanning line before a first scanning line of a plurality of scanning lines of a display area or a dummy scanning line after a last scanning line of the plurality of scanning lines of the display area.

11. A pixel configured to adjust a light-emitting time of an external pixel to display gradation, by the external pixel, based on a logic level of a data signal transmitted to each of a plurality of sub-fields forming a frame, the pixel comprising:

a first transistor comprising a gate electrode configured to receive a scanning signal, a first electrode configured to receive the data signal having a first logic level or a second logic level opposite to the first logic level, and a second electrode coupled to a first node;

a second transistor comprising a gate electrode coupled to the first node, a first electrode configured to receive a first source voltage, and a second electrode coupled to a fourth node;

a third transistor comprising a gate electrode coupled to a second node, a first electrode coupled to the fourth node, and a second electrode configured to receive a second source voltage, the second source voltage being lower than the first source voltage;

a fourth transistor comprising a gate electrode coupled to the first node, a first electrode configured to receive the first source voltage, and a second electrode coupled to a third node;

a fifth transistor comprising a first electrode coupled to the third node, a gate electrode and a second electrode diode-coupled and receiving the second source voltage;

a sixth transistor comprising a gate electrode configured to receive the scanning signal, a first electrode coupled to the third node, and a second electrode coupled to the second node;

a first capacitor comprising a first electrode coupled to the first node, and a second electrode configured to receive the first source voltage; and a second capacitor comprising a first electrode coupled to the second node, and a second electrode coupled to the fourth node, wherein the fourth node is insulated from a repair line by interposing an insulation layer.

12. The pixel of claim 11, wherein the fourth node is electrically coupled to the repair line, the repair line being coupled to a light-emitting device of the external pixel, the first transistor is configured to transmit the data signal having the first logic level to the first node to turn on the second transistor; and the sixth transistor is configured to transmit the first source voltage, to the second node to turn off the third transistor, the first source voltage being transmitted to the third node by the fourth transistor turned on by the data signal having the first logic level.

13. The pixel of claim 12, wherein when the first transistor and the sixth transistor are turned off as the scanning signal is reversed in the sub-field, the second capacitor is coupled to the repair line to keep the third transistor off.

14. The pixel of claim 11, wherein the fourth node is electrically coupled to the repair line, the repair line being coupled to a light-emitting device of the external pixel, the first transistor is configured to transmit the data signal of the second logic level to the first node and turns off the second transistor, and the sixth transistor is configured to transmit the second source voltage to the second node to turn on the third transistor, the second source voltage being transmitted to the third node by the fifth transistor when the fourth transistor is turned off by the data signal having the second logic level.

15. The pixel of claim 14, wherein when the first transistor and the sixth transistor are turned off as the scanning signal is reversed in the sub-field, the second capacitor is coupled to the repair line to keep the third transistor on.

16. A pixel configured to adjust a light-emitting time of an external pixel to display gradation, by the external pixel, based on a logic level of a data signal transmitted to a plurality of sub-fields forming a frame, the pixel comprising:

a first transistor comprising a gate electrode configured to receive a scanning signal, a first electrode configured to receive the data signal having a first logic level or a second logic level opposite to the first logic level, and a second electrode coupled to a first node;

a second transistor comprising a gate electrode coupled to the first node, a first electrode configured to receive a first source voltage, and a second electrode coupled to a third node;

a third transistor comprising a gate electrode coupled to a second node, a first electrode coupled to the third node, and a second electrode configured to receive a second source voltage, the second source voltage being lower than the first source voltage;

a fourth transistor comprising a gate electrode configured to receive the scanning signal, a first electrode configured to receive a reverse data signal opposite to the data signal, and a second electrode coupled to the second node;

a first capacitor comprising a first electrode coupled to the first node, and a second electrode configured to receive the first source voltage; and a second capacitor comprising a first electrode coupled to the second node, and a second electrode coupled to the third node, wherein the third node is insulated from a repair line by interposing an insulation layer.

17. The pixel of claim 16, wherein the third node is electrically coupled to the repair line, the repair line being coupled to a light-emitting device of the pixel, the first transistor is configured to transmit the data signal having the first logic level to the first node to turn on the second transistor, and the fourth transistor is configured to transmit the reverse data signal to the second node to turn off the third transistor.

18. The pixel of claim 17, wherein when the first and fourth transistors are turned off as the scanning signal is reversed in the sub-field, the second capacitor is coupled to the repair line to keep the third transistor off.

19. The pixel of claim 16, wherein the third node is electrically connected to the repair line, the repair line being coupled to a light-emitting device of the external pixel, the first transistor is configured to transmit the data signal having the second logic level to the first node to turn off the second transistor, and the fourth transistor is configured to transmit the reverse data signal to the second node to turn on the third transistor.

20. The pixel of claim 19, wherein when the scanning signal is reversed in the sub-field, and the first and fourth transistors are turned off, the second capacitor is coupled to the repair line to keep the third transistor on.

* * * * *